US005732445A

United States Patent [19]

Stodolka et al.

[11] Patent Number: 5,732,445

[45] Date of Patent: Mar. 31, 1998

[54] RETAINER FOR ELECTRIC CORD CONNECTORS

[76] Inventors: John T. Stodolka, 13843 Guild Ave., Apple Valley, Minn. 55124; Mary E. Imgrund, 4456 Otter Lake Rd., White Bear Lake, Minn. 55110

[21] Appl. No.: 746,471

[22] Filed: Nov. 12, 1996

Related U.S. Application Data

[63] Continuation of Ser. No. 372,939, Jan. 17, 1995, abandoned.

[51] Int. Cl.[6] ..... H01R 13/639; B65B 13/02; A44B 18/00

[52] U.S. Cl. ..... 24/16 R; 439/369; 24/306; 24/129 R; 24/115 A

[58] Field of Search ..... 24/16 R, 115 A, 24/136 R, 16 PB, 18, 306, 115 K, 115 G, 115 H, 115 R, 129 R; 248/51, 52, 205.1, 205.2, 205.3, 309.1; 439/369, 371, 370, 501

[56] References Cited

U.S. PATENT DOCUMENTS

| | | | |
|---|---|---|---|
| 4,114,838 | 9/1978 | Knouf | 24/16 R X |
| 4,229,924 | 10/1980 | Teachout, Sr. | 24/16 R X |
| 4,470,174 | 9/1984 | Reah | 24/16 BP X |
| 4,629,977 | 12/1986 | Howard | 24/16 R |
| 4,690,476 | 9/1987 | Morganrath | 439/369 X |
| 4,854,015 | 8/1989 | Shaull | 24/16 R |
| 4,957,450 | 9/1990 | Pioszak | 439/396 |
| 5,015,251 | 5/1991 | Cherubini | 24/16 R X |
| 5,024,402 | 6/1991 | Hamel | 24/16 BP X |
| 5,048,158 | 9/1991 | Koerner | 24/16 R |
| 5,075,933 | 12/1991 | Kemper | 24/16 R |
| 5,075,934 | 12/1991 | Oseda | 24/16 R |
| 5,104,335 | 4/1992 | Conley et al. | 439/369 |
| 5,133,671 | 7/1992 | Boghosian | 24/16 PB X |
| 5,167,524 | 12/1992 | Falcon et al. | 439/369 X |
| 5,168,603 | 12/1992 | Reed | 24/16 R |
| 5,336,107 | 8/1994 | Sheryll | 439/369 |

*Primary Examiner*—James R. Brittain
*Assistant Examiner*—Robert J. Sandy
*Attorney, Agent, or Firm*—Herman H. Bains

[57] ABSTRACT

A retainer device for holding a pair of electrical connector plugs in interconnected relation includes an elongate flexible strip formed of velcro material. The strip is of rectangular configuration and has a pair of slits in the end portions thereof. The interconnected electric plugs extend through the slits and the end portions of the strip are folded over into overlapped relation and are releasably connected together.

1 Claim, 1 Drawing Sheet

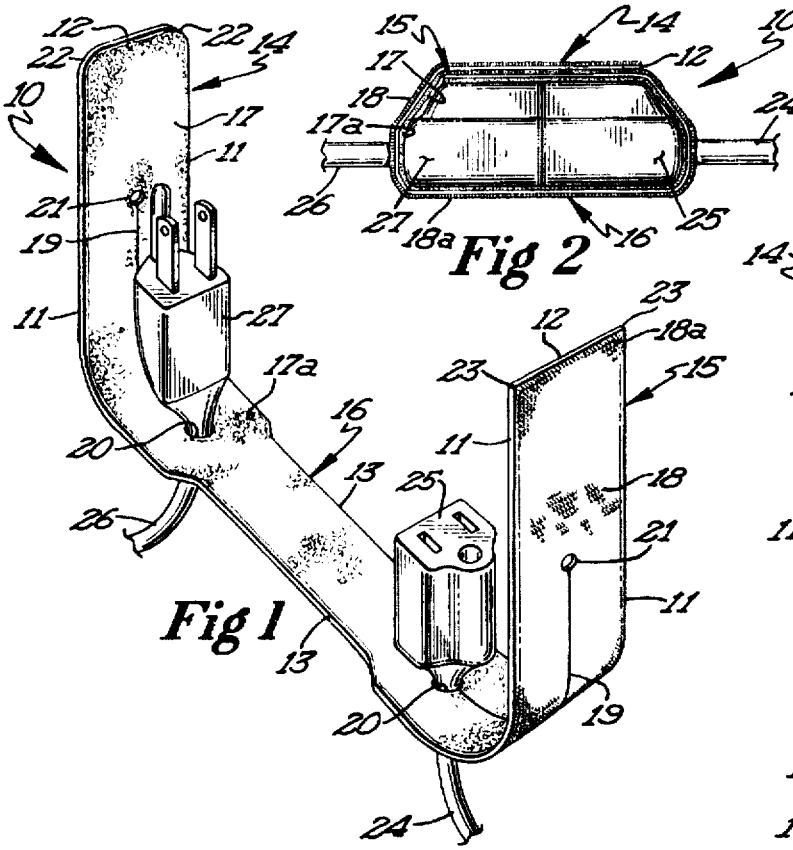
Fig 1
Fig 2
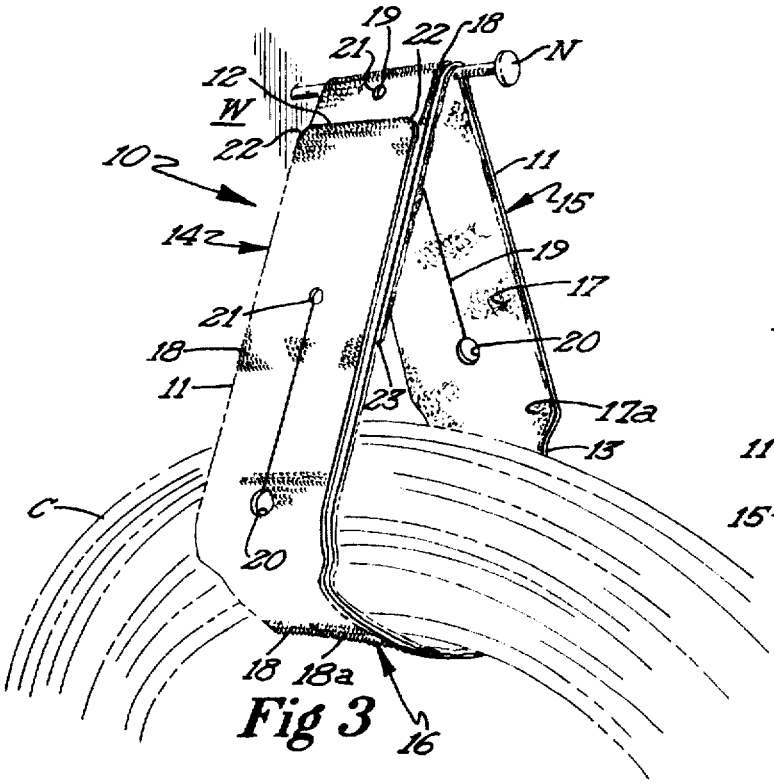
Fig 3
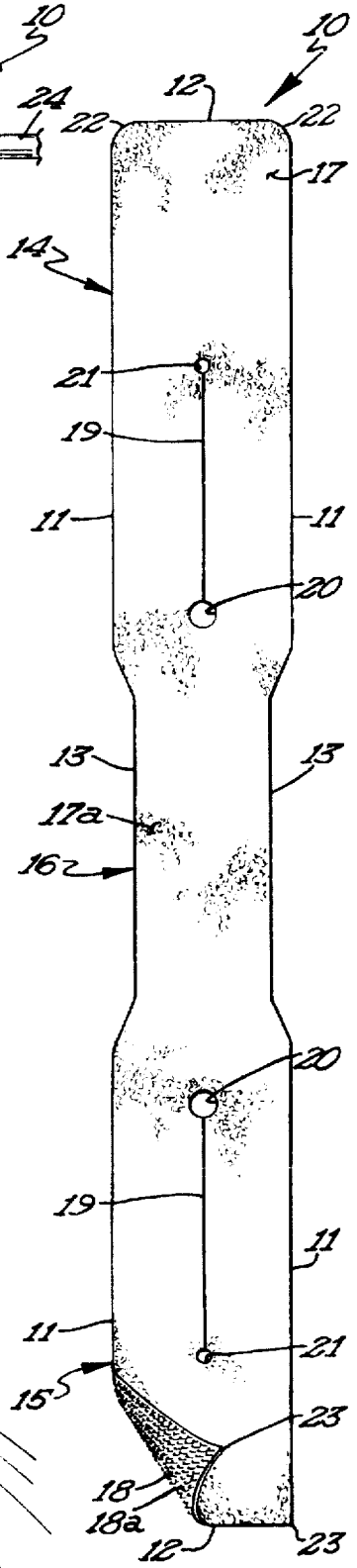
Fig 4

RETAINER FOR ELECTRIC CORD CONNECTORS

This is a Continuation of application Ser. No. 08/372,939 filed on Jan. 17, 1995, now abandoned.

FIELD OF THE INVENTION

This invention relates to a device for effectively holding the male and female plugs of a pair of electric cords together.

BACKGROUND OF THE INVENTION

Conventional male and female bayonet connectors are used to connect electric cords together and usually provide a relatively firm connection. However, when interconnected electric cord plugs are subjected to a pulling force of a predetermined magnitude, the connectors will readily separate. For example, such accidental disconnections occur when one of the cords is connected to a power tool or implement which is constantly being moved. Similarly, where a number of such interconnected electric cords are being used, such as a construction site, accidental disconnections are relatively common place.

Certain commercial devices are presently available for holding electrical connectors in a connected condition but these commercial devices are of rigid construction and serve only to retain the electrical connectors in the connected condition. Furthermore, when these rigid commercial devices are not being used to retain a pair of electrical connectors, these devices are disassociated from the electric cord and are subject to being misplaced.

SUMMARY OF THE INVENTION

It is an object of this invention to provide a novel retainer device for retaining interconnected connectors of electrical conductor cords in interconnected relation. The retainer device is formed of a strip of flexible material provided with openings to permit the cords and connectors to pass therethrough. In one embodiment of the invention, the device is formed of VELCRO and the end portions thereof are folded into overlapped relation and releasably secured together for retaining the connectors in interconnected relationship. The flexible retainer device remains with the electric cord when not in use, and may be used as a carrying handle for a coiled electric cord or may be used to hang a coil cord from a wall support. The commercial retainers for electrical connectors do not have this versatile utility.

BRIEF DESCRIPTION OF THE FIGURES OF THE DRAWING

FIG. 1 is a perspective view of the novel flexible retainer illustrated in an intermediate step of interconnecting a pair of electric cord-attached connectors together;

FIG. 2 is a side elevational view illustrating the novel retainer in a locked retaining position;

FIG. 3 is a perspective view illustrating the retainer serving as a means for hanging a coiled electric cord in suspended relation, and;

FIG. 4 is a plan view of the novel retainer with an end corner portion of the retainer being folded over to illustrate the other surface.

DESCRIPTION OF THE PREFERRED EMBODIMENT

Referring now to the drawings, more particularly to FIG. 1, it will be seen that one embodiment of the novel retainer device, designated generally by the reference numeral 10, is thereshown. In the preferred embodiment of the invention, the retainer device comprises a single piece strip of flexible material, preferably wide VELCRO one wrap material which is of generally rectangular configuration. The retainer device includes longitudinal edges 11 and transverse edges 12 at each end. It will be noted that the longitudinal edges are recessed intermediate the ends of the strip as at 13 to thereby form the strip into an end portion 14, an end portion 15 and a central portion 16. The central portion 16 has the inwardly recessed longitudinal edge portions 13. In the embodiment shown, the end portion 14 is slightly longer than the end portion 15.

Since the elongate strip forming the retainer device is formed of VELCRO, the inner surface 17 thereof is provided with hooks **17*a* throughout its surface area while the outer surface 18*a* is provided with loops. It will also be noted that each end portion 14, 15 is provided with an elongate centrally located slit 19 therethrough. The inner end of each slit terminates in a small opening 20 while the outer end of each slit terminates in a small opening 21. The openings 20, 21 for the slits 19** are circular in configuration and serve to prevent tear and minimize excess tension thereat.

It will also be noted that the end portion 14 has wide angular corners 23.

The retainer device 10 serves to retain electric cord-attached connectors in connected relation and thereby serves to prevent accidental disconnection of the electric cords. Referring now to FIG. 1, it will be seen that an electric cord 24 is provided with a conventional female bayonet plug connector 25 while the electric cord 26 is provided with a three prong bayonet male type plug connector 27. FIG. 1 illustrates the use of the retainer in an intermediate position before it is manipulated to form its retaining configuration illustrated in FIG. 2. The female plug 25 and the male plug 27 will be first inserted through the slits 19 in the end portions 14, 15 of the retainer and the connector plugs will thereafter be connected in the conventional manner. The end portions 14, 15 will then be disposed in overlapped relation and will releasably engage each other via the hooks **17*a* and loops 18*a* on the inner and outer surfaces. In this regard, it will be noted hooks 17*a* are formed throughout the inner surface 17 while the loops 18*a* are formed throughout the outer surface 18. When the retainer device 10** is used to retain male and female cord-attached connectors together, there will be little if any likelihood of the interconnected plugs from becoming accidentally pulled apart.

It will further be noted that when the plugs are interconnected together, the two plugs will be positioned upon the inner surface of the central portion 16 of the connector device. With this arrangement, it will be noted that the retainer device may be readily applied to and disconnected from a pair of interconnected electric plugs to assure the plugs remain in interconnected relationship.

When the connector plugs are in a disconnected condition, the retainer device 10 may be simply left in engaging relation with at least one of the electrical conductors 24, 26. The electric cord simply projects through the retainer and remains attached thereto. In this way, there is little likelihood of misplacing the retainer device. It is also pointed out that the retainer device may be used to retain a male type plug element in interconnected relation with a bus power strip connector. In this regard, the male bayonet plug will extend through a slit 19 and the retainer device will be wrapped around the bus power strip connector with the end portions and overlapped relationship. The retainer device may be also be used to retain small electric plugs in interconnected relation to larger electric plugs with the assurance that the interconnected plugs will not be accidentally disconnected. When the device is not being used to retain two interconnected plugs in connected relation, the device may be used as a carrying handle for a coiled electric cord in which the user grips or carries the retainer by the central portion 16. It will also be noted from FIG. 3 that the device may be used to suspend a coiled electrical cord from a wall support.

It is pointed out that while the preferred embodiment of the retainer device is formed of a one wrap VELCRO material, the device may also be formed of other flexible materials such as plastic, fabric or similar and flexible materials. For example, if the retainer device is formed of plastic, the plastic retainer will be provided with strips of VELCRO to serve as fasteners applied to the inner and outer surfaces of the end portions 14 and 15.

From the foregoing, it will be seen that the novel retainer device is highly effective in retaining a pair of interconnected electric plugs in interconnected relation. The ability of an electrical cord to project through a slit in an end portion of the retainer device, permits the retainer device to remain with an electrical cord and minimize any tendency of the retainer device being misplaced. The retainer device may also be used to support and carry a coiled electrical cord and may be readily and easily applied and removed from interconnected plugs.

Thus is will be seen that I have provided a novel retainer device which is not only of simple and inexpensive construction but one that functions in a more efficient manner than any heretofore comparably device.

What is claimed is:

1. A flexible retainer for engaging and retaining electrical cord-attached interconnected male and female connectors comprising:

a generally rectangular shaped elongate flexible strip having inner and outer surfaces and including a pair of end portions and an intermediate portion, said intermediate portion having a width dimension smaller than the width dimension of the end portions and having a length dimension corresponding to the length of a pair of interconnected male and female electrical connectors, each end portion having an elongate substantially straight slit therein extending longitudinally of the strip, each slit having inner and outer ends and being of a linear size for permitting an electrical male or female connector pass there through, the male and female electrical connectors when interconnected together and retained by the flexible retainer being positioned upon the intermediate portion with the end portions engaging the electrical connectors and being disposed in overlapped engaging relation with respect to each other, each slit having a circular opening at opposite ends thereof, said opening at the inner end of each slit being disposed adjacent an end of said intermediate portion and sized for receiving the electrical cord of a connector therethrough, the electrical cord of a connector being completely seated within the opening at the inner end of the associated slit, said flexible strip being formed of VELCRO including hooks and loops, said hooks entirely covering one of said inner or outer surfaces, and said loops entirely covering the other surface, the hooks and loops of said overlapped end portions engaging each other to releasably lock the end portions together to retain a pair of electrical plugs and interconnected relation whereby a linear pull on the electrical cord of a connector will cause the connector to bear against that part of an end portion containing the opening in which the electrical cord is seated.

* * * * *